US007703533B2

(12) United States Patent
Ashy et al.

(10) Patent No.: US 7,703,533 B2
(45) Date of Patent: Apr. 27, 2010

(54) SHEAR TYPE CIRCULATION VALVE AND SWIVEL WITH OPEN PORT RECIPROCATING FEATURE

(75) Inventors: Thomas M. Ashy, Lafayette, LA (US); Gregory L. Hern, Huffman, TX (US)

(73) Assignee: Baker Hughes Incorporated, Houston, TX (US)

( * ) Notice: Subject to any disclaimer, the term of this patent is extended or adjusted under 35 U.S.C. 154(b) by 227 days.

(21) Appl. No.: 11/751,960

(22) Filed: May 22, 2007

(65) Prior Publication Data

US 2007/0284111 A1 Dec. 13, 2007

Related U.S. Application Data

(60) Provisional application No. 60/809,378, filed on May 30, 2006.

(51) Int. Cl.
*E21B 34/12* (2006.01)

(52) U.S. Cl. ..... 166/334.1; 166/331; 166/334.4; 166/332.1

(58) Field of Classification Search ..... 166/316, 166/332.1, 333.1, 334.1, 334.4, 331
See application file for complete search history.

(56) References Cited

U.S. PATENT DOCUMENTS

| | | | | |
|---|---|---|---|---|
| 2,797,755 | A | 7/1957 | Bobo | |
| 3,198,256 | A | 8/1965 | Kirby | |
| 3,280,923 | A | 10/1966 | Muench | |
| 3,712,115 | A | 1/1973 | Miller | |
| 3,969,937 | A * | 7/1976 | Barrington et al. | 166/264 |
| 4,452,313 | A | 6/1984 | McMahan | |
| 4,458,762 | A * | 7/1984 | McMahan | 166/373 |
| 4,469,174 | A | 9/1984 | Freeman | |
| 4,520,870 | A | 6/1985 | Pringle | |

(Continued)

FOREIGN PATENT DOCUMENTS

| | | |
|---|---|---|
| GB | 2272923 | 6/1994 |

(Continued)

OTHER PUBLICATIONS

Baker Hughes, Baker Oil Tools, Circulation Control Joint Technical Information, Oct. 1, 2003, 1 page.

(Continued)

*Primary Examiner*—John Kreck
(74) *Attorney, Agent, or Firm*—Steve Rosenblatt

(57) ABSTRACT

A tool and associated method allows a liner top to be dressed. Then while maintaining a lateral port closed the tool can be used to circulate while being rotated and reciprocated. The tool features discrete j-slot mechanisms. The upper j-slot allows the lateral port to initially open while the lower j-slot keeps the lateral port open despite movement of the tool in opposed directions in the hole due to a barrier to the pin in the lower j-slot. When enough weight is set or the barrier is otherwise removed, the lateral port can be closed and the test packer set by set down weight with the lateral port closed. After the packer is unset the lateral ports can be reopened and circulation and swiveling on a bearing can occur even if the packer is temporarily actuated from the setting down motion that reopened the lateral ports.

18 Claims, 7 Drawing Sheets

U.S. PATENT DOCUMENTS

| | | | |
|---|---|---|---|
| 4,809,793 | A | 3/1989 | Hailey |
| 5,014,780 | A | 5/1991 | Skipper |
| 5,123,489 | A | 6/1992 | Davis et al. |
| 5,176,208 | A | 1/1993 | Lalande et al. |
| 5,265,675 | A | 11/1993 | Hearn et al. |
| 5,287,930 | A | 2/1994 | McGill |
| 5,320,176 | A | 6/1994 | Naquin et al. |
| 5,375,662 | A | 12/1994 | Echols et al. |
| 5,402,850 | A | 4/1995 | Lalande et al. |
| 5,499,687 | A | 3/1996 | Lee |
| 5,765,640 | A | 6/1998 | Milne et al. |
| 5,881,816 | A | 3/1999 | Wright |
| 6,102,060 | A | 8/2000 | Howlett et al. |
| 6,152,220 | A | 11/2000 | Carmichael et al. |
| 6,152,221 | A | 11/2000 | Carmichael et al. |
| 6,152,228 | A | 11/2000 | Carmichael |
| 6,176,311 | B1 | 1/2001 | Ryan |
| 6,220,357 | B1 | 4/2001 | Carmichael et al. |
| 6,227,291 | B1 | 5/2001 | Carmichael et al. |
| 6,250,387 | B1 | 6/2001 | Carmichael et al. |
| 6,253,861 | B1 | 7/2001 | Carmichael et al. |
| 6,276,452 | B1 | 8/2001 | Davis et al. |
| 6,279,657 | B1 | 8/2001 | Carmichael et al. |
| 6,305,469 | B1 | 10/2001 | Coenen et al. |
| 6,431,292 | B2 | 8/2002 | Mocivnik et al. |
| 6,454,009 | B2 | 9/2002 | Carmichael et al. |
| 6,478,088 | B1 | 11/2002 | Hansen et al. |
| 6,719,052 | B1 | 4/2004 | Harmon et al. |
| 6,776,231 | B2 | 8/2004 | Allen |
| 6,896,074 | B2 | 5/2005 | Cook et al. |
| 6,951,251 | B2 | 10/2005 | Penisson |
| 7,108,067 | B2 | 9/2006 | Themig et al. |
| 7,188,675 | B2 | 3/2007 | Reynolds |
| 7,264,047 | B2 | 9/2007 | Brezinski et al. |
| 7,467,664 | B2 | 12/2008 | Cochran et al. |
| 7,467,665 | B2 | 12/2008 | Mackenzie |
| 2002/0104649 | A1 | 8/2002 | Allen |
| 2002/0112862 | A1* | 8/2002 | Patel ..... 166/386 |
| 2002/0162655 | A1 | 11/2002 | Lynde et al. |
| 2005/0217864 | A1 | 10/2005 | Carmichael |

FOREIGN PATENT DOCUMENTS

| | | |
|---|---|---|
| GB | 2335687 | 9/1999 |

OTHER PUBLICATIONS

Baker Hughes, Baker Oil Tools, Pump Out Sub Technical Information, Jun. 7, 2005, 1 page.

BJ Services Company, Dual Ball-Drop Circulating Sub Product Information, Apr. 11, 2006, 1 page.

MFCT, Mechanical Wellbore Cleanup: Circulating Sub (Weight); Heavy Duty Clutch Type; SPS International 2006, 2 pps.

Coronado, Martin P., et al., "Next-Generation Sand Screen Enables Drill-In Sandface Completions", SPE 113539, Jun. 2008, 1-13.

Chapman, Walt, "Using Monobore System to Lower Completion Costs in Short-Life Wells", SPE 113315, Jun. 2008, 1-7.

Augustine, Jody, et al., "World's First Gravel-packed Inflow-Control Completion", SPE 103195, SPE Drilling and Completion, Mar. 2008, 61-67.

* cited by examiner

SHEAR TYPE CIRCULATION VALVE AND SWIVEL WITH OPEN PORT RECIPROCATING FEATURE

PRIORITY INFORMATION

This application claims the benefit of U.S. Provisional Application No. 60/809,378, filed on May 30, 2006.

FIELD OF THE INVENTION

The field of the invention is well cleanup tools that allow a tubular top to be dressed, the mud conditioned or displaced in the liner, and above the liner through lateral ports, as well as setting a packer to test integrity of the cementing of the tubular.

BACKGROUND OF THE INVENTION

In well completions a liner is typically inserted in the drilled wellbore and cemented. Thereafter the integrity of the cementing needs to be tested and that is accomplished with a pressure test using a packer set above the liner top. To avoid damage to tools that may be later set in the liner, the top of the liner needs to have a relatively burr free internal surface. Typically, a mill is used to dress the liner top. It is advantageous to condition the mud above the liner and to do it with relatively high circulation rates. To accomplish that a tool with a lateral port has been used that can open, when needed to allow conditioning.

Typically, these ported tools involve a ported mandrel in a ported housing where the ports can be selectively put into alignment for flow and misalignment to close off flow. In the past the required relative movement to go between the open and closed positions has been accomplished with j-slot mechanisms that involve relative movement between a pin on one part and a slot on the other. Progress of the pin in the slot could be obtained by cycling pressure on and off that forced relative movement between a j-slot sleeve and a lug to advance the lug in a j-slot track or by mechanical movement of the pin or slot with the other held supported. For example a mandrel with a pin extending into a slot on a surrounding housing that is supported in the well could allow the mandrel to take several positions with respect to the surrounding housing. That relative movement could result in aligning or misaligning of ports. The limitations of such j-slot mechanisms are that the pin continues to progress in the slot if there is reciprocating movement of the tool for other purposes. In that case if aligned ports were needed to stay aligned during reciprocating tool movement for another purpose such as conditioning the mud through a lateral port while reciprocating the tool the length of tubulars that can be assembled on a rig floor, for example about 90 feet, the j-slot mechanisms would not assure that the aligned ports would not go to a misaligned position and thus nullify the mud conditioning effort that was in progress. Thus, one advantage of the present invention allows the lateral port to remain open for conditioning by having a barrier to the progress of the lug out of a desired slot in the j-slot while mud is conditioned above a liner top.

Tools in the past have included bearings so that when weight was set down on the bearing the mandrel could rotate with ports in the mandrel selectively aligned with ports in the housing, as long as weight was set down. This rotation of the mandrel feature allowed better agitation of the mud as different outlets around the circumference of the outer housing saw flow in turn as the mandrel rotated. The problem was that if the tool was moved longitudinally back and forth from the position it took to align the ports such as if the span of the conditioning zone was 90 feet, for example, the j-slot device would cycle and the ports may no longer stay aligned.

What was needed in a cleanup and test tool of this type is an ability to open the lateral ports and hold them open while the tool is cycled up and down for a long distance and then later be able to close them. Another desirable feature was to be able to later still open the ports and circulate and swivel before pulling the tool out of the hole. These and other features of the present tool and associated method of the present invention will be more readily apparent to those skilled in the art from a review of the detailed description and the associated drawings and the claims below that define the full scope of the invention.

SUMMARY OF THE INVENTION

A tool and associated method allows a liner top to be dressed. Then while maintaining a lateral port closed the tool can be used to circulate while being rotated and reciprocated. The tool features discrete j-slot mechanisms. The upper j-slot allows the lateral port to initially open while the lower j-slot keeps the lateral port open despite movement of the tool in opposed directions in the hole due to a barrier to the pin in the lower j-slot. When enough weight is set or the barrier is otherwise removed, the lateral port can be closed and the test packer set by set down weight with the lateral port closed. After the packer is unset the lateral ports can be reopened and circulation and swiveling on a bearing can occur even if the packer is temporarily actuated from the setting down motion that reopened the lateral ports.

DETAILED DESCRIPTION OF THE DRAWINGS

FIGS. 1*a*-1*c* show the tool in the run in position;

FIGS. 2*a*-2*c* shows the tool with the lateral port open position where the tool can be swiveled, reciprocated and circulated with the lateral ports remaining open;

FIGS. 3*a*-3*c* show the tool with the lower j-slot disabled and the tool in position to swivel on the bearing to displace mud from above the packer;

DETAILED DESCRIPTION OF THE PREFERRED EMBODIMENT

Figure 1A:
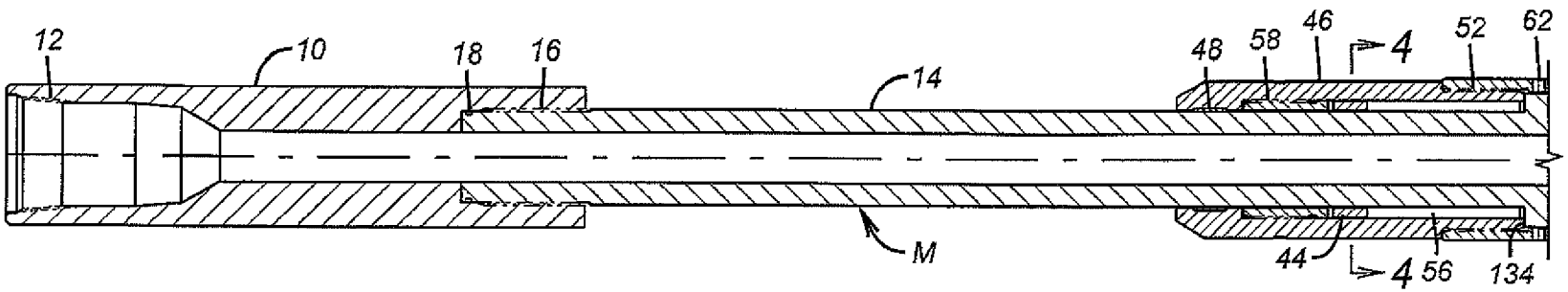
Figure 1B:
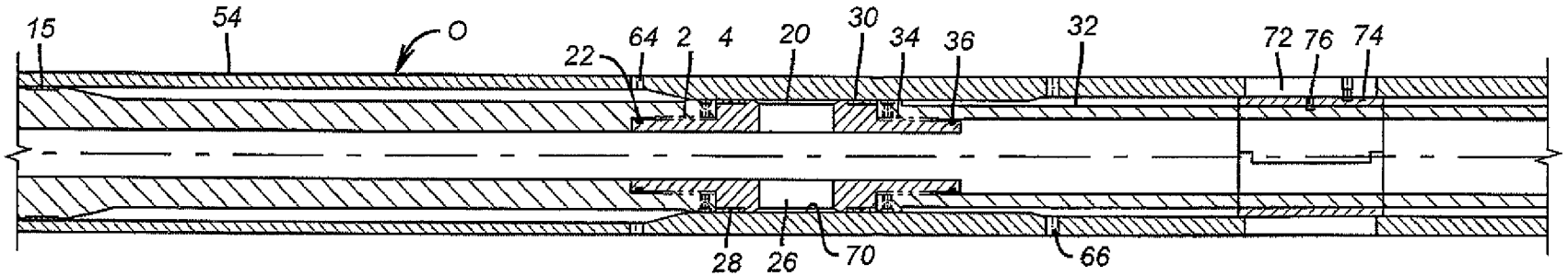
Figure 1C:
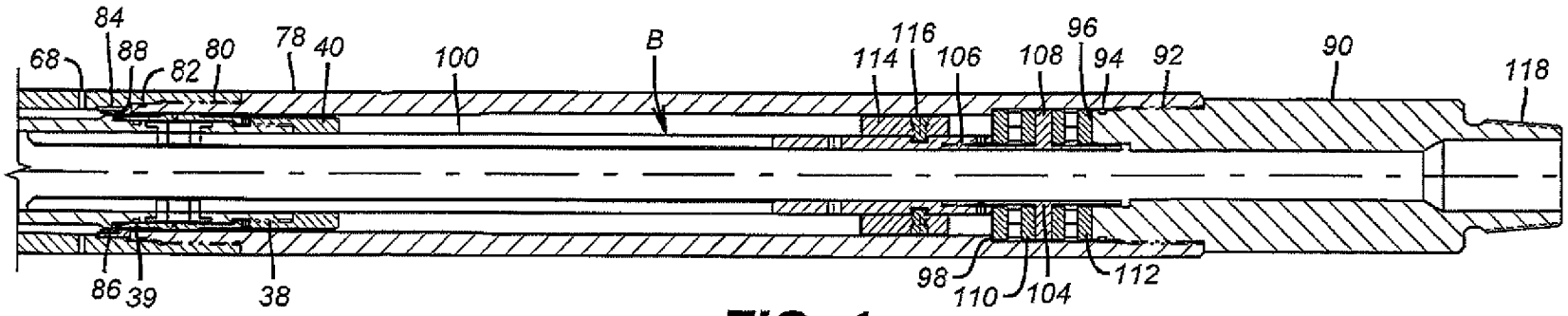
Figure 4:
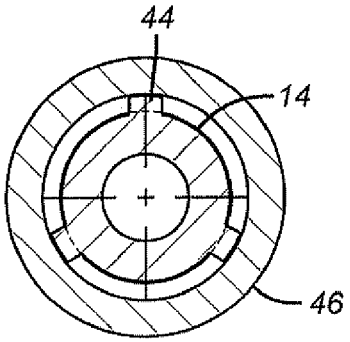
FIG. 4 is a section through the upper pin of the upper j-slot taken along lines 4-4 of FIG. 1*a;*

Referring to FIGS. 1*a*-1*c* the tool has a multipart mandrel M made up of top sub 10 having a thread 12 to which the work string (not shown) is attached for manipulation of the mandrel M. Upper mandrel 14 is connected to top sub 10 at thread 16 that is sealed with seal 18. Upper mandrel 14 has a bushing 15 that rides inside of upper sleeve 54. Port sub 20 is connected to upper mandrel 14 at thread 22 that is sealed by seal 24. Port sub 20 has one or more ports 26 around its circumference and ports seals 28 and 30 straddle ports 26. Lower mandrel 32 is attached to port sub 20 at thread 34 that is sealed by seal 36. Bottom sub 40 is secured to lower mandrel 32 at thread 38 that is sealed by seal 39 and retains one or more radially inwardly oriented lugs 42 that extend through the lower mandrel 32. Referring back to FIG. 1*a* and FIG. 4, upper mandrel 14 has one or more radially outwardly oriented lugs 44 that are part of the upper j-slot assembly as will be later described. Lugs 42 are part of the lower j-slot assembly as will be later described. The various parts of the mandrel M have now been described. Next, the outer assembly O will be described in great detail.

Figure 5:
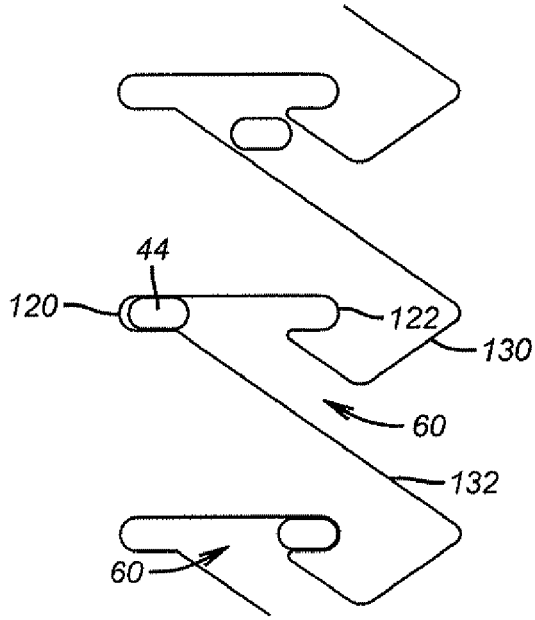
FIG. 5 is a layout of the upper j-slot.

The outer assembly O begins with a top sub 46 that has a bushing 48 that rides on upper mandrel 14. Upper sleeve 54 is secured at thread 52 to top sub 46. Upper j-slot sleeve 56 is secured at thread 58 to top sub 46. FIG. 5 shows a rolled flat view of upper j-slot sleeve 56 with lug 44 in the several positions that it can take along track 60. In the section view of FIG. 1*a* the upper j-slot sleeve 56 is seen disposed on both sides of lug 44. Upper sleeve 54 has a series of openings 62, 64, 66 and 68 that prevent liquid lock between the mandrel M and the outer assembly O. Seals 28 and 30 on the mandrel M engage surface 70 on upper sleeve 54 to keep port 26 closed for run in. Upper sleeve 54 also has a port 72 that is capped shut for run in by sleeve 74 retained by a shear pin 76.

Lower sleeve 78 is connected to upper sleeve 54 at thread 80 and sealed at 82. Lower sleeve 78 traps retainer 84 between itself and sleeve 54. Retainer 84 supports part of a z-shaped shear ring 86 to sleeves 54 and 78 while a shoulder 88 on lower mandrel 32 rests on shear ring 86 for run in for reasons that will be explained below. Bottom sub 90 is secured to lower sleeve 78 at thread 92 and sealed by seal 94. Opposed surfaces 96 on bottom sub 90 and 98 on lower sleeve 78 contain bearing assembly B that will be described below.

Figure 6:
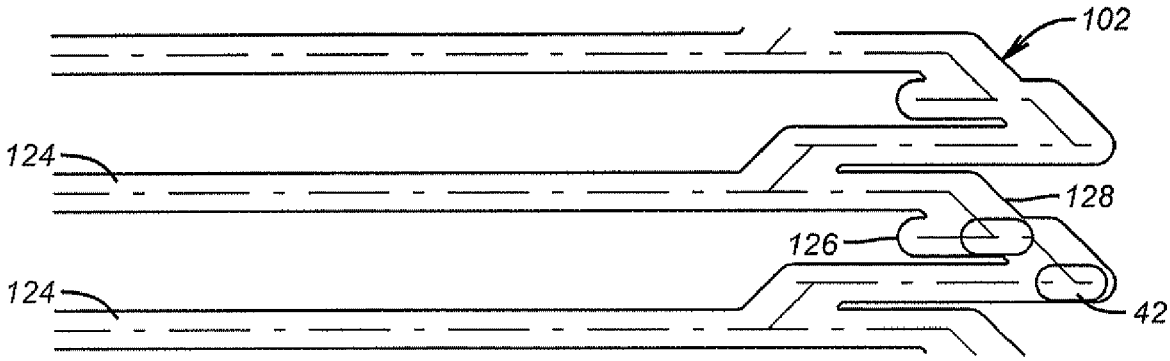
FIG. 6 is a layout of the lower j-slot.
Figure 7:
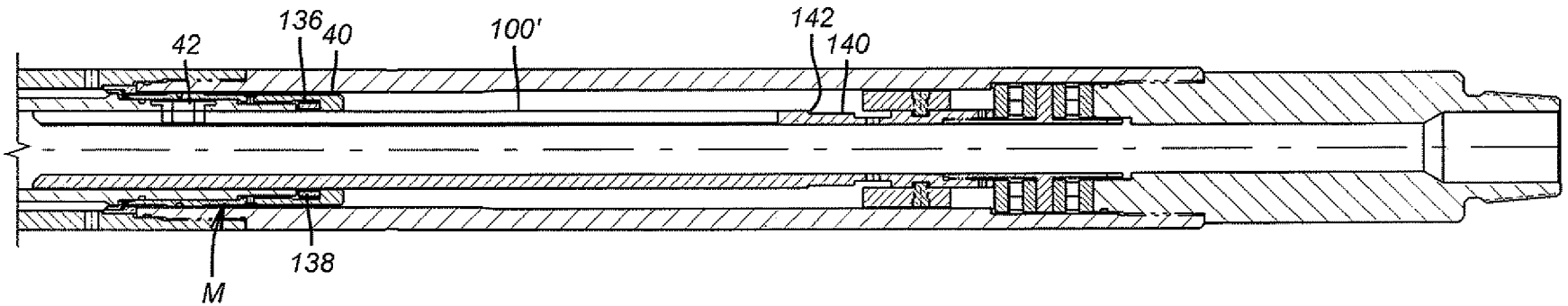
FIG. 7 show a section of a snap ring alternative, in the run in position, to the lower j-slot shown in FIG. 6.

The lower j-slot sleeve 100 has a track 102 that is shown in rolled out form in FIG. 6 along with lug 42 that travels track 102. Bearing retainer 104 is secured to lower j-slot sleeve 100 at thread 106. Retainer 104 has a rib 108 with bearings 110 and 112 above and below rib 108 respectively. A shear ring 114 is pinned by pin 116 to lower j-slot sleeve 100 for purposes that will be explained when the operation is reviewed.

The major parts of the tool now having been described, the operation will be reviewed in greater detail. While not shown, those skilled in the art will appreciate that supported at thread 118 on bottom sub 90 is a string that extends into the liner that has been hung off a higher casing that has been cemented. That string supports the mill by extending through it and goes to close to the liner bottom. That string also supports a packer above the mill that is used to dress the liner top so that it later can accept a packer connected to a production string. The packer that is used with this tool is set in the casing above the liner for a test to determine if there is fluid loss into the formation when pressure is applied against the set packer.

In operation, the tool shown in FIGS. 1*a*-1*c* is lowered into position and the mill (not shown) is used to dress the liner top. After that the tool with the pipe extending from thread 118 is rotated and reciprocated while fluid in the liner is conditioned. During this operation the outer assembly O may be put into a supported position off the liner top but care is taken to avoid loading the mandrel M to the point that shoulder 88 shears the z-shaped shear ring 86. With ring 86 intact, the mandrel M cannot move with respect to the outer assembly O. The next step is to condition the mud above the liner top. For this operation, the outer assembly O is lowered to a supported position off the liner top and weight is set down on the mandrel M to the point that shoulder 88 breaks the shear ring 86. The downward movement to break the shear ring 86 has lug 44 moving from position 120 to position 122 in track 60. There the weight of the string above the tool is on lugs 44 as position 122 traps lugs 44 in upper j-slot sleeve 56. At the same time lug 42 simply moves down in track 124 but not quite to the point shown in FIG. 6.

Figure 2A:
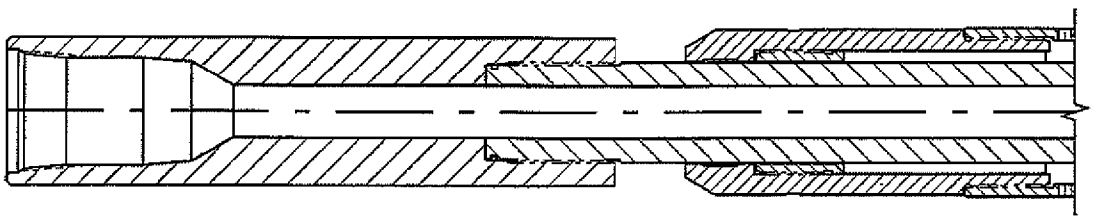
Figure 2B:
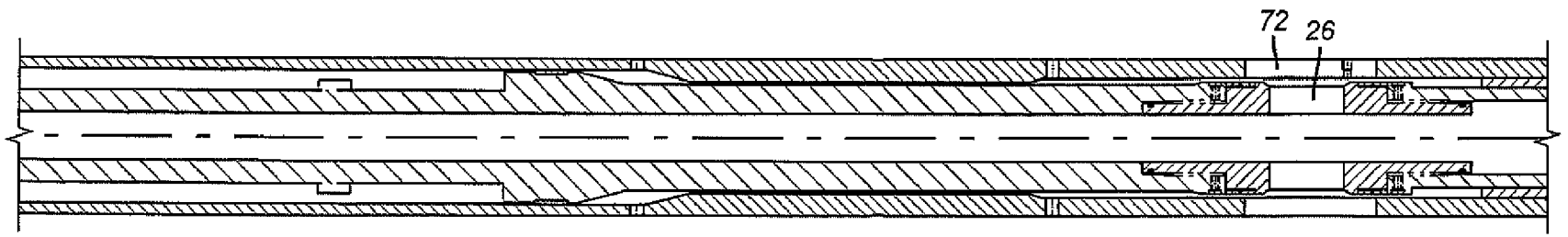
Figure 2C:
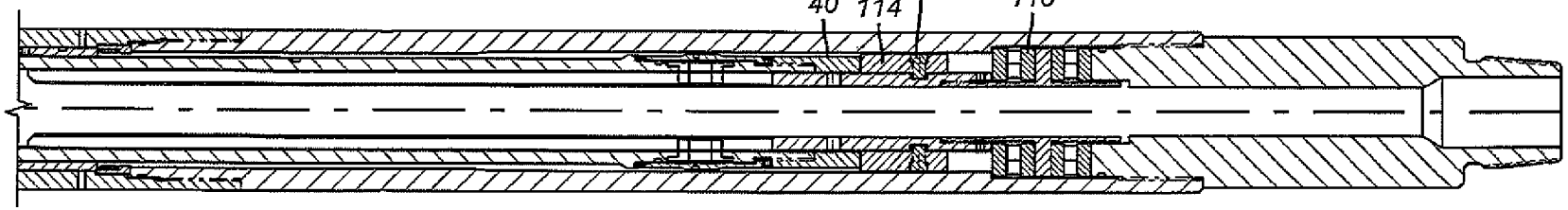

Next the mandrel M is picked up and rotated right while being let down. This movement takes lug 44 along the slanted path shown at the top of FIG. 5 and out of upper j-slot sleeve 56 to let the mandrel M descend further since lugs 44 are free from being trapped in position 122. The mandrel can then descend until its bottom sub 40 engages the shear ring 114 but does not break the shear pins 116 that retain it to lower j-slot sleeve 100. While this movement is going on, the lugs 42 continue their descent in track 124 shown in FIG. 5. The turning of the mandrel M to get lugs 44 out of upper j-slot sleeve 56 simply has the effect of rotation of lower j-slot sleeve 100 by lugs 42 as they travel down track 124. At the time when bottom sub 40 of mandrel M hits the shear ring 114, the lugs 42 have just reached ramp 128 at the bottom of track 124, as shown in FIG. 6. There is still enough mandrel movement left at that point before engaging the shear ring 114 so as to allow lugs 42 to go down ramp 128 into track 126 that is a very short track parallel to track 124. Those skilled in the art will appreciate that the movement of the mandrel M to the just described position aligns ports 72 and 26 so that high flow circulation can take place through those aligned ports while the tool is reciprocated and rotated. There is no rotation of the outer assembly O because bearings 110 and 112 allow for such relative rotation. With the shear ring 114 in place lugs 42 can't escape track 126 and despite the relative longitudinal motion allowed by lugs 42 moving from one end to the other of track 126, the ports 26 and 72 maintain sufficient longitudinal alignment for high flow rate circulation despite tool reciprocation and rotation of mandrel M. This position of the tool is shown in FIGS. 2*a*-2*c*. In this position the mud above the liner top can be conditioned as the tool is used for circulation while it is picked up and set down with the mandrel M rotating. Again there is the assurance of aligned ports 72 and 26 to permit circulation despite the up and down movements or mandrel M rotation.

Those skilled in the art will appreciate that the present invention encompasses other ways to retain the tool in the desired position during this step than using a j-slot with a feature to temporarily trap a lug in a j-slot. In fact, the use of a temporary block of a lug in a j-slot is not limited to circulation tools discussed above but rather has broad applications to other downhole tools. Additional features can be added to the above described tool to protect the shear pins 116 from breaking early. For example, another sleeve with a ball seat can be placed in a supporting position to the ring 114 so that pins 116 can't shear until a ball lands on a seat of a supporting sleeve to move it away from supporting ring 114 so that impact can then break pins 116 in the manner that will be described below. Yet other types of temporary retaining devices can be used instead of the ring 114 interfering with movement of lug 42 in j-slot sleeve 100 as will be described below. The procedure being described herein can be modified to even eliminate the lower j-slot sleeve 100 and the associated lug 42, if desired.

Figure 3A:
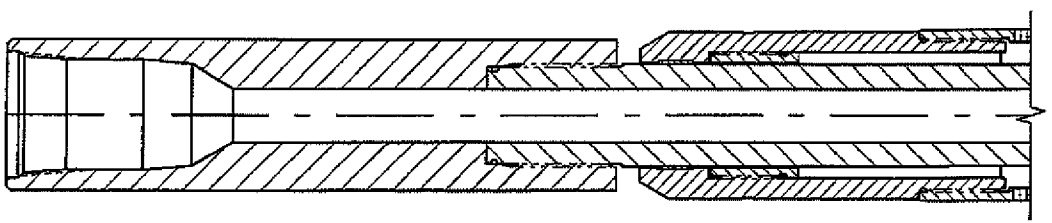
Figure 3B:
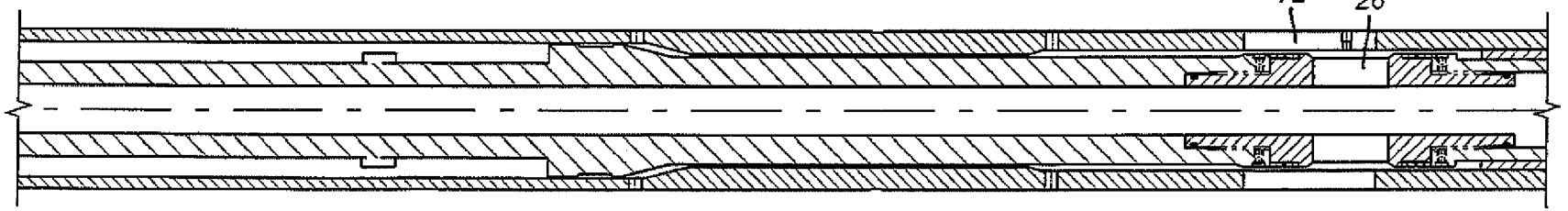
Figure 3C:
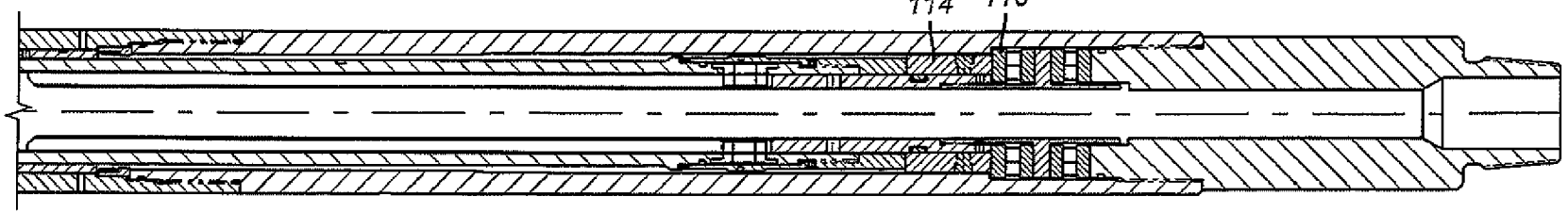

When the conditioning of the mud above the liner top is concluded, weight is set down on mandrel M to break shear pins 116 and doing so lets the shear ring 114 drop down onto the bearing 110, as shown in FIG. 3*c*. Because the ring 114 is displaced, the lug 42 can exit short track 126 as shown in the bottom of FIG. 6. At that point a pickup force on mandrel M will bring lug 42 up the next track 124'. As that is happening, lug 44 will enter track 60 guided by tapered surfaces 130 and 132, as shown in FIG. 5. Lug 42 will first hit the upper position 120 and after weight is set down on mandrel M will settle into position 122. At this point the ports 26 and 72 will be misaligned and isolated as the tool assumes the run in position of FIG. 1, with the main difference being that shear pins 116 and shear ring 86 are now both broken.

However, before setting down weight to get lug 44 in position 122 displacing fluid can be pumped through the tool into the liner to displace the mud out of it and position the displaced mud at a location above where the packer (not shown) will be set to test the cement integrity of the liner. When the displacing is done then the mandrel is lowered without rotation to set the packer. Here lug 44 will be in position 122. After the test with the packer is completed, the packer is unset by picking up on mandrel M which engages surface 134 of upper mandrel 14 to top sub 46 of the outer assembly O pulling up the outer assembly O and stretching out the packer to release it. This engagement can be seen in the run in position in FIG. 1*a*. The liner can then be circulated through the string extending through it that is supported at threads 118. The mandrel M can then be set down while being rotated right to allow lug 44 to exit track 60. At this point the tool will be in the position of FIGS. 3*a*-3*c*. The ports 72 and 26 will be aligned and the mandrel M will rest on ring 114 which in turn will rest on bearing 110. At this point the mud that was earlier conditioned above the packer can be displaced from the hole while the mandrel M is rotated on bearing 110 without being picked up since at this point picking up will misalign ports 72 and 26. The tool can then be pulled out of the hole.

Those skilled in the art can appreciate that the tool can save the operator rig time in that the mud conditioning can be done above the liner top in a shorter period of time if the drill string is rotated and reciprocated up and down during circulation while still retaining the flexibility to close the ports for mud displacement from the liner and open them again for displacement of mud from above the packer after the cement integrity test.

Figure 8:
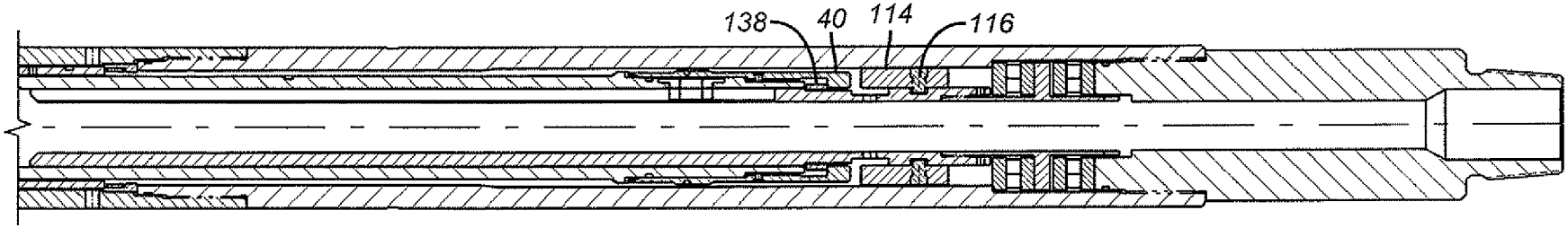
FIG. 8 is the view of FIG. 7 with the snap ring securing the ports open position and the mandrel picked up.
Figure 9:
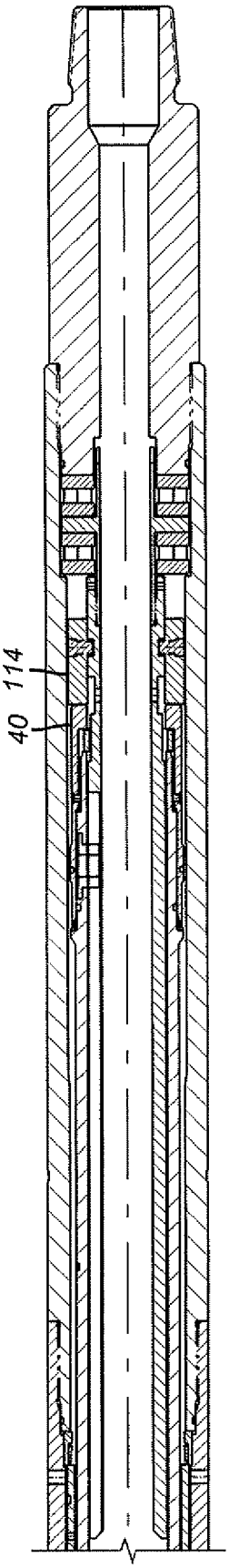
FIG. 9 is the view of FIG. 7 with the mandrel set down.
Figure 10:
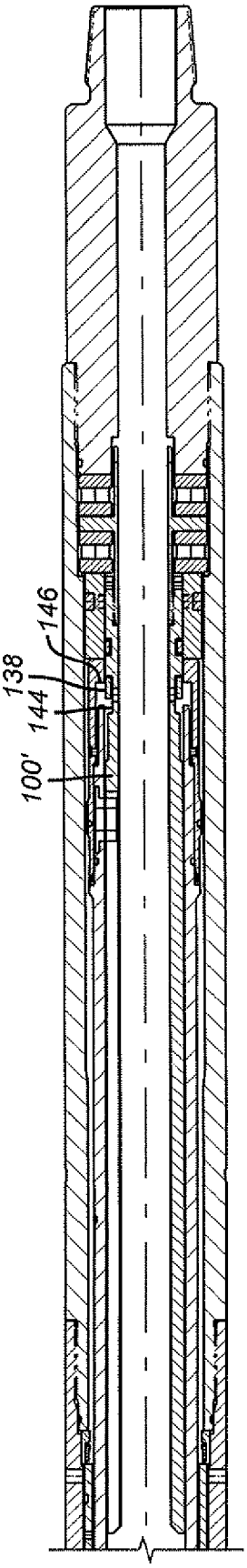
FIG. 10 is the view of FIG. 9 with weight set down moving the shear ring and allowing the snap ring to snap in further for a release between the mandrel and the outer assembly so the ports can close.

Referring now to FIGS. 7-10 there is illustrated an alternative embodiment to the use of the lower j-slot sleeve 100. In this embodiment the bottom sub 40 of mandrel M has a recess 136 that carries a snap ring or equivalent device that stores energy 138. In the run in position that this Figure illustrates, the snap ring 138 is prevented from collapse by sleeve 100' that this time has a single straight slot (not shown) that lug 42 rides in. When lug 44 is brought out of upper j-slot sleeve 56 as previously described, the bottom sub 40 of mandrel M brings down lug 42 and snap ring 138 until the snap ring 138 lines up and snaps into groove 140 that is defined by shoulder 142 and the lower end of sleeve 100'. This position is illustrated in FIG. 8. In this position, the mandrel M including the lug 42 is prevented from moving up the not shown groove in sleeve 100' by shoulder 142. The mandrel M is prevented from moving down by the presence of shear ring 114 held by shear pins 116. In FIG. 8 the mandrel M is pulled up showing a gap between bottom sub 40 and ring 114. In FIG. 9 weight is set down on the mandrel M closing that gap with the pins 116 still intact. After the conditioning step above the liner top is concluded involving circulation, picking the mandrel M up and setting it down while rotating it, the mandrel M is set down hard enough to break shear pins 116 to allow ring 114 to move down as shown in FIG. 10. In this position, snap ring 138 is clear of surface 146 on the mandrel M since it is in lower groove 144 in sleeve 100'.

Figure 11:
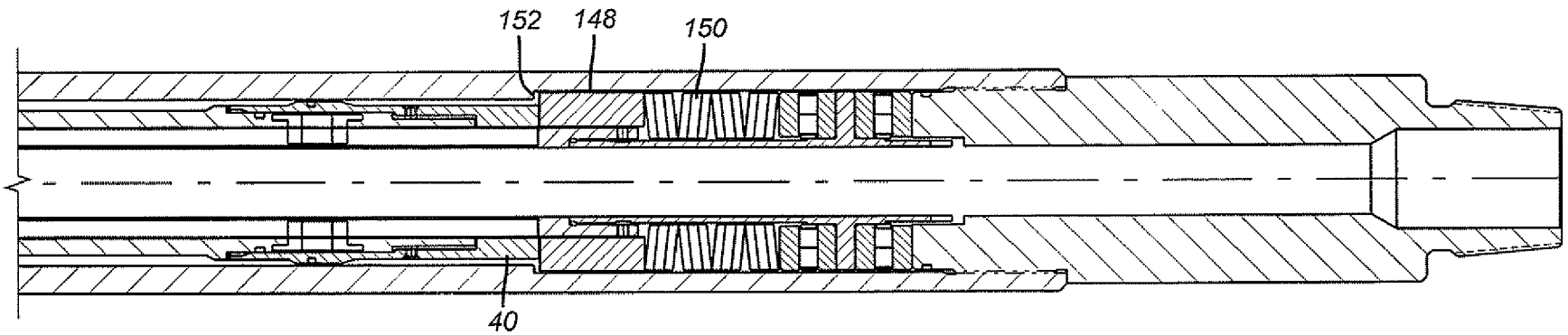
FIG. 11 shows an alternative to using the shear ring 114 pinned by pins 116 in a design that lets the lateral flow ports be held open more than a single time.

Referring now to FIG. 11 there is shown a structure that can replace the ring 114 and associated pins 116. With the ring and pins design, the lug 42 can be trapped in track 126 to hold the ports 26 and 72 aligned while the mandrel M is picked up or set down and rotated. It isn't until the pins 116 are broken that lug 42 can exit track 126 to allow the mandrel to come up to the point where the ports 26 and 72 are no longer in flow communication. In that version, once the pins 116 are broken, the alignment of ports 26 and 72 can no longer be secured. Thus only weight being set down on mandrel M after pins 116 are broken will keep those ports aligned. The FIG. 11 design operates to keep the lug 42 in track 126 by landing bottom sub 40 of mandrel M on ring 148 that is biased by a stack of Belleville washers or an equivalent bias force 150. The operation to retain the lug 42 in track 126 is the same as using the ring 114. As long as the contact force on ring 148 is not excessive, it will not move and lug 42 will not be able to exit from track 126. However, if enough downward force on mandrel M is applied, the ring 148 is displaced as washers 150 are compressed and the lug 42 can move out of short track 126. The difference is that the washers 150 force the ring 148 back to its original position against shoulder 152 to allow the trapping of lug 42 in track 126 a multiple number of times rather than just once as the design using ring 114 with pins 116 would allow.

The above description is illustrative of the preferred embodiment and many modifications may be made by those skilled in the art without departing from the invention whose scope is to be determined from the literal and equivalent scope of the claims below.

We claim:

1. A circulation tool for downhole use, comprising:

a body having a lateral port and a mandrel having a passage and a mandrel port communicating with said passage, said body and mandrel relatively movable between two positions where said ports are either aligned for flow therethrough to or from said passage and misaligned where there is no appreciable flow therethrough, said tool initially movable between said first and a second positions by at least setting down weight on the tool while it is supported downhole;

said tool retaining said second position when subsequently picked up more than one time from the support downhole or set down on the support with a force below a predetermined value, whereupon application of a setting down force in excess of said predetermined value, said tool returns to said first position.

2. The tool of claim 1, wherein:

said tool returns to said first position after being picked up after said set down that is accomplished with said predetermined force.

3. The tool of claim 2, wherein:

said tool, after being set down with said predetermined force when in said second position, can no longer retain said second position when subsequently picked up and set down.

4. The tool of claim 2, wherein:

said tool, after being set down with said predetermined force when in said second position, can still retain said second position when subsequently picked up and set down.

5. The tool of claim 4, wherein:

said body and said mandrel are movably connected via a j-slot assembly comprising a pin mounted to one of said body and said mandrel and movable in a circumferentially disposed slot mounted to the other of said body and said mandrel;

said pin encountering a biased obstruction that only allows further travel in said slot when a predetermined force that overcomes said bias is applied to it.

6. The tool of claim 5, wherein:

said tool retaining said second position despite one or more pin contacts with said obstruction that each do not exceed said predetermined force.

7. The tool of claim 6, wherein:

upon application of said predetermined force, said pin can advance in said slot past said obstruction so as to allow the tool to return to said first position.

8. The tool of claim 7, wherein:

said bias resets said obstruction after said pin clears it with said predetermined force only to have said pin again encounter said obstruction so that for another time the second position can be retained as long as a predetermined force on said pin is not exceeded.

9. The tool of claim 8, wherein:

said ports are misaligned in said first position and aligned in said second position.

10. The tool of claim 3, wherein:

said body and said mandrel are movably connected via a j-slot assembly comprising a pin mounted to one of said body and said mandrel and movable in a circumferentially disposed slot mounted to the other of said body and said mandrel;

said pin encountering an obstruction that only allows further travel in said slot when a predetermined force that overcomes said bias is applied to it.

11. The tool of claim 10, wherein:

said obstruction is disabled once initially overcome by said predetermined force.

12. The tool of claim 11, wherein:

said ports are misaligned in said first position and aligned in said second position.

13. The tool of claim 3, wherein:

said body and said mandrel are movably connected and selectively retained to each other via a snap ring in one of said body and said mandrel and a first groove in the other of said body and said mandrel;

whereupon initial setting down weight on the tool said snap ring enters said first groove and straddles said mandrel and said body to selectively retain the tool in said second position against movement in a first direction.

14. The tool of claim 13, further comprising:

a travel stop selectively preventing sufficient movement in a second direction as long as a predetermined force applied to it is not exceeded, said force being in a direction opposite said first direction.

15. The tool of claim 14, wherein:

upon application of a predetermined force to said travel stop, said snap ring no longer straddles said body and said mandrel.

16. The tool of claim 15, wherein:

said travel stop is retained by at least one shear pin;

upon breaking of said pin a second groove is presented in alignment with said snap ring allowing it to move radially so that it no longer straddles said body and said mandrel.

17. The tool of claim 16, wherein:

said second groove is deeper in a radial direction toward a longitudinal axis of said mandrel than said first groove.

18. The tool of claim 17, wherein:

said ports are misaligned in said first position and aligned in said second position.

* * * * *